US010690010B2

(12) United States Patent
Harris et al.

(10) Patent No.: US 10,690,010 B2
(45) Date of Patent: Jun. 23, 2020

(54) STEAM REBOILER WITH TURBINE

(71) Applicant: UOP LLC, Des Plaines, IL (US)

(72) Inventors: James W Harris, Palatine, IL (US); Stanley Joseph Frey, Palatine, IL (US)

(73) Assignee: UOP LLC, Des Plaines, IL (US)

( * ) Notice: Subject to any disclaimer, the term of this patent is extended or adjusted under 35 U.S.C. 154(b) by 40 days.

(21) Appl. No.: 15/923,995

(22) Filed: Mar. 16, 2018

(65) Prior Publication Data

US 2019/0284961 A1 Sep. 19, 2019

(51) Int. Cl.

| | |
|---|---|
| ***F01K 13/02*** | (2006.01) |
| ***F01K 17/02*** | (2006.01) |
| ***F01K 13/00*** | (2006.01) |
| ***F01K 7/16*** | (2006.01) |

(52) U.S. Cl.

CPC ..... *F01K 13/02* (2013.01); *F01K 7/16* (2013.01); *F01K 13/003* (2013.01); *F01K 17/02* (2013.01)

(58) Field of Classification Search

CPC ..... F22B 3/02; F22B 1/1838; F01K 13/02; F01K 13/006; F01K 25/14; F01K 7/16; F01K 17/02; F01K 13/00; F01K 13/003; C10G 11/18; C10G 11/182; C10G 11/185; C10G 11/187; C10G 45/72; C10G 47/36; C10G 2300/4012

See application file for complete search history.

(56) References Cited

U.S. PATENT DOCUMENTS

| | | | | |
|---|---|---|---|---|
| 4,285,481 | A | 8/1981 | Biscomb | |
| 4,401,560 | A * | 8/1983 | Vidueira | C10G 21/00 208/321 |
| 4,455,614 | A | 6/1984 | Martz et al. | |
| 4,920,276 | A | 4/1990 | Tateishi et al. | |
| 5,384,489 | A | 1/1995 | Bellac | |
| 6,009,711 | A | 1/2000 | Kreiger et al. | |
| 6,265,453 | B1 | 7/2001 | Kennedy | |
| 6,354,084 | B1 | 3/2002 | McKinley et al. | |
| 6,681,155 | B1 | 1/2004 | Fujita et al. | |
| 6,898,540 | B2 * | 5/2005 | Davies | G05B 23/0221 702/105 |
| 6,962,199 | B1 | 11/2005 | Willink | |

(Continued)

FOREIGN PATENT DOCUMENTS

| | | | |
|---|---|---|---|
| BY | 20923 | C1 | 4/2017 |
| CN | 102203780 | A | 9/2011 |

(Continued)

OTHER PUBLICATIONS

Frey, Stanley Joseph, et al., U.S. Appl. No. 15/923,990, filed Mar. 16, 2018 and entitled "Turbine with Supersonic Separation".

(Continued)

*Primary Examiner* — Mark A Laurenzi
*Assistant Examiner* — Xiaoting Hu

(57) ABSTRACT

A steam reboiler unit that includes turbines for reducing the pressure of various streams associated with the reboilers. The turbines generate electricity from the pressure reduction which can be recovered and utilized elsewhere in the processing unit. Data from the turbine associated with the amount of electrical power generated by the turbine is used to adjust other processing conditions to provide for a more efficient operation of the processing unit.

11 Claims, 1 Drawing Sheet

(56) References Cited

U.S. PATENT DOCUMENTS

| | | | | |
|---|---|---|---|---|
| 7,267,746 | B1 * | 9/2007 | Harris | B01D 3/141 196/111 |
| 7,757,493 | B2 | 7/2010 | Bell et al. | |
| 7,948,101 | B2 | 5/2011 | Burtch | |
| 8,404,918 | B2 | 3/2013 | Frey | |
| 8,510,015 | B2 | 8/2013 | Beausoleil et al. | |
| 8,763,625 | B1 | 7/2014 | Carter | |
| 8,967,590 | B2 | 3/2015 | Minervini et al. | |
| 9,085,499 | B2 | 7/2015 | Frey et al. | |
| 9,235,228 | B2 | 1/2016 | Gazit et al. | |
| 9,764,272 | B2 | 9/2017 | Martin et al. | |
| 2005/0034463 | A1 | 2/2005 | Simpson et al. | |
| 2008/0015839 | A1 | 1/2008 | Noureldin et al. | |
| 2009/0125152 | A1 | 5/2009 | Skowronski et al. | |
| 2009/0211252 | A1 * | 8/2009 | Tani | F01K 7/345 60/645 |
| 2011/0077448 | A1 | 3/2011 | Frey | |
| 2011/0100004 | A1 | 5/2011 | Al-Mazeedi | |
| 2012/0107227 | A1 | 5/2012 | Fischer et al. | |
| 2012/0118526 | A1 | 5/2012 | Sudau et al. | |
| 2012/0186252 | A1 * | 7/2012 | Schmidt | F22B 1/18 60/649 |
| 2012/0227440 | A1 | 9/2012 | Guidati et al. | |
| 2012/0245754 | A1 | 9/2012 | Mehnert | |
| 2012/0260667 | A1 | 10/2012 | Chillar et al. | |
| 2012/0326443 | A1 * | 12/2012 | Vince | F01D 15/10 290/7 |
| 2013/0199185 | A1 | 8/2013 | Wain et al. | |
| 2014/0331672 | A1 | 11/2014 | Filippi et al. | |
| 2015/0107252 | A1 * | 4/2015 | Okaichi | F01D 17/20 60/660 |
| 2015/0118131 | A1 | 4/2015 | Martin et al. | |
| 2016/0079756 | A1 | 3/2016 | Ikeyama et al. | |
| 2016/0122667 | A1 * | 5/2016 | Evans | C10G 9/36 208/70 |
| 2016/0141878 | A1 | 5/2016 | Johansen | |
| 2016/0161536 | A1 | 6/2016 | Amminudin | |
| 2016/0252015 | A1 | 9/2016 | Kusumi et al. | |
| 2016/0319198 | A1 | 11/2016 | Quanci et al. | |
| 2017/0058206 | A1 | 3/2017 | Noureldin et al. | |
| 2017/0058207 | A1 | 3/2017 | Noureldin et al. | |

FOREIGN PATENT DOCUMENTS

| | | | |
|---|---|---|---|
| CN | 103917280 | A | 7/2014 |
| CN | 104463341 | A | 3/2015 |
| CN | 206538206 | | 10/2017 |
| EP | 0552039 | | 7/1993 |
| EP | 2778354 | A1 | 9/2014 |
| FR | 2414162 | | 8/1979 |
| RU | 155185 | U1 | 9/2015 |
| RU | 2014114067 | | 10/2015 |
| WO | 2014119569 | A1 | 8/2014 |
| WO | 2014178079 | A2 | 11/2014 |
| WO | 2016004014 | A1 | 1/2016 |
| WO | 2016177376 | A1 | 11/2016 |

OTHER PUBLICATIONS

Frey, Stanley J., et al., U.S. Appl. No. 62/644,086, filed Mar. 16, 2018 and entitled "System for Consolidation and Use of Power Recovered from A Turbine in a Process Unit".

Frey, Stanley J., et al., U.S. Appl. No. 62,644,104, filed Mar. 16, 2018 and entitled "System for Power Recovery from Quench and Dilution Vapor Streams".

Frey, Stanley Joseph, et al., U.S. Appl. No. 15/924,037, filed Mar. 16, 2018 and entitled "Power Recovery from Quench and Dilution Vapor Streams".

Frey, Stanley J., U.S. Appl. No. 15/923,936, filed Mar. 16, 2018 and entitled "Energy-Recovery Turbines for Gas Streams".

Frey, Stanley J., et al., U.S. Appl. No. 15/923,945, filed Mar. 16, 2018 and entitled "Consolidation and Use of Power Recovered from a Turbine in a Process Unit".

Harris, James W., et al., U.S. Appl. No. 15/924,034, filed Mar. 16, 2018 and entitled "Use of Recovered Power in a Process".

Frey, Stanley J., et al., U.S. Appl. No. 15/923,964, filed Mar. 16, 2018 and entitled "Process Improvement through the Addition of Power Recovery Turbine Equipment in Existing Processes".

Frey, Stanley Joseph, et al., U.S. Appl. No. 15/923,997, filed Mar. 16, 2018 and entitled "Processes for Adjusting at Least One Process Condition of a Chemical Processing Unit with a Turbine".

Frey, Stanley Joseph, et al., U.S. Appl. No. 15/923,978, filed Mar. 16, 2018 and entitled "Hydroprocessing Unit with Power Recovery Turbines".

Tsourapas, Vasilios, Control Analysis of Integrated Fuel Cell Systems with Energy Recuperation Devices, 2007.

The Elliot Group, Maximize the Efficiency of your Steam Process, 2014.

U.S. Department of Energy, Replace Pressure-Reducing Valves with Backpressure Turbogenerators.

Mechanical Solutions, Inc., Replacing a Pressure Reducing Valve with a Hydro Turbine for a Municipal Water Supply, Jul. 19, 2016.

Mohammadzadeh, Ashkan, et al., Design of a wind turbine model for clean energy. Case study: Khorasan Razavi regional electricity company, Acta Technica, 62, No. 4B/2017-1-8.

Guitiérrez-Antonio, Claudia, et al, Intensification of the hydrotreating process to produce renewable aviation fuel through reactive distillation, Science Direct, vol. 124, Feb. 2018.

International Search Report from corresponding PCT application No. PCT/US2019/022428, dated Jun. 27, 2019.

Written Opinion from corresponding PCT application No. PCT/US2019/022428, dated Jun. 24, 2019.

* cited by examiner

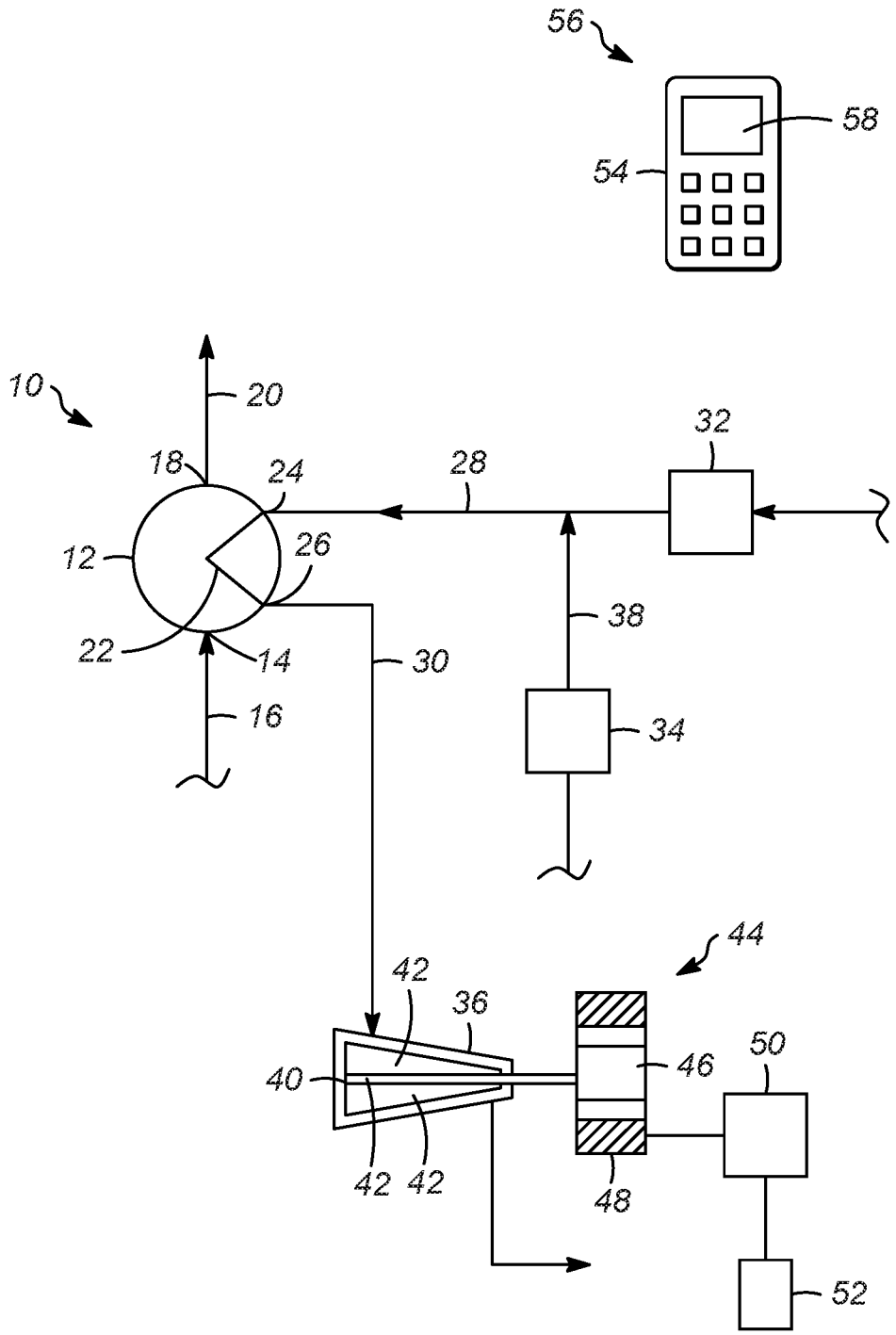
56
58
54
10
20
18
24
28
32
12
26
38
22
14
30
16
34
44
42
36
50
40
46
42
42
48
52

STEAM REBOILER WITH TURBINE

FIELD OF THE INVENTION

This invention relates generally to a reboiler in a chemical processing or refining unit, and particularly a steam reboiler, and more particularly, a steam reboiler which includes a turbine for converting energy into electricity.

BACKGROUND OF THE INVENTION

Chemical refining and processing methods frequently involve converting a liquid to a vapor with a reboiler. One such example for a reboiler is a tube-in-shell steam reboiler. In the steam reboiler, steam is condensed by transferring thermal energy to a process liquid. The process liquid is vaporized by the thermal energy and returned to the process as process vapor, where, for example in a fractionation column, the vapor will interact with other molecules and separate into different components within the fractionation column.

Such a reboiler often utilizes one or more control valves to adjust the pressure or temperature of the various streams associated with the reboiler. For example, a control valve is utilized to reduce a pressure of the steam stream to limit the ultimate temperature of the steam in a heat exchanger within the reboiler. Additionally, a control valve is utilized with boiler feedwater mixed with the steam to remove any superheat. The boiler feedwater is at a much higher pressure and therefore, a control valve is needed to reduce the pressure of the boiler water, allowing it to be mixed with the steam. Furthermore, once the steam is condensed in the heat exchanger within the reboiler, a control valve is utilized with the hot condensate to modulate the duty of the reboiler.

While the reboilers achieve their intended purposes, the control valves are a source of energy loss associated with the pressure reduction of the streams. Specifically, in the control valve, mechanical energy is dissipated by the valve in a thermodynamically adiabatic, highly irreversible process. Since the energy is removed in such an irreversible process, via the pressure reduction, without recovery, the energy is lost.

Because the pressure reduction across the control valve is irreversible, it results in a lower pressure steam with greater amounts of superheat than at the inlet of the valve. For the purposes of maximizing the utility of the heat exchanger surface area, the steam should condense immediately upon entering the heat exchanger to minimize the heat exchanger surface area. With high amounts of superheat, for example greater than 20 degrees C., a large amount of exchanger surface area is involved in slow heat transfer of sensible heat removal from the steam. To ensure quick condensation of the steam in the heat exchanger, some water is added to the steam downstream of the control valve to minimize the steam superheat. This addition of water adds cost to the system and therefore it is desirable to be minimized or eliminated.

Returning to the energy dissipated across the control valve; this dissipated energy is often associated with energy added to the system. Thus, there is an inherent inefficiency in the process associated with supplying energy only to remove it without recovery. In the past, the cost of recovering this energy has not been justified; however, with increased mandates for improvements in energy efficiency and reduction of greenhouse gas emissions, the elimination of these oft-overlooked inefficiencies provides a means to address these new mandates. Moreover, this inefficiency is an opportunity for processors to lower operating costs and, thus increase profits.

Therefore, there is a need for an effective and efficient device and process for recovering energy from the reboiler. Additionally, it would be desirable for such devices and processes to allow processors to analyze the inefficiency of removing energy that has been added and adjust processing conditions to minimize the added energy without impacting the overall throughput of the processing/refining unit.

SUMMARY OF THE INVENTION

The present invention attempts to overcome one or more shortcomings associated with the conventional reboilers. Specifically, according to the present invention, the control valves in the reboilers are replaced with turbines. With turbines, the same pressure reduction is achieved by the reboiler unit. However, unlike the control valves, the turbines convert the removed energy into electrical energy that is utilized elsewhere in the processing unit and remove much of the superheat from the steam requiring less water for de-superheating. It is preferred to reduce the amount of superheat in the steam line after the turbine to less than 20 degrees C. superheat and most preferably to less than 5 degrees C. superheat. Thus, the turbines provide an advantage over the traditional control valves. In the reboiler described above, the turbine is able to provide information about the amount of energy removed. This information may be utilized to determine adjustments for various processing conditions which reduce the amount of energy added to the process. This permits the processor to more efficiently operate the process unit without reducing the throughput of the process unit.

The present invention may be characterized, in at least one aspect, as providing a process for recovering electrical power from a steam reboiler system with a turbine by: converting an inlet liquid process stream into a vapor phase and a liquid phase in a reboiler; heating the inlet liquid process stream within the reboiler with a stream of steam with a heat exchanger having an inlet and an outlet; reducing a pressure of the stream of steam with a turbine prior to heating the inlet liquid process stream; recovering condensate from the outlet after heating the inlet liquid process stream; rotating a turbine wheel within the turbine, the turbine wheel configured to transmit rotational movement to an electrical generator; and, generating electricity with the turbine.

In a second aspect, the present invention may be generally characterized as providing a process for recovering electrical power from a steam reboiler with a turbine by: passing a liquid process stream to a reboiler; passing a stream of steam into a heat exchanger disposed within the reboiler; heating the liquid process stream in the reboiler with the stream of steam; recovering a stream of condensate from the heat exchanger; recovering a mixed stream from the reboiler, the mixed stream comprising the liquid process stream and a vapor portion of the liquid process stream; controlling the flow or pressure of the stream of steam with at least one turbine, the at least one turbine being disposed in a condensate recovery line, in a steam supply line, or both; and, generating electricity with the at least one turbine.

In yet a third aspect, the present invention, broadly, may be characterized as providing an apparatus for boiling a liquid stream in a reboiler. The apparatus includes a vessel with at least one inlet configured to receive a liquid process stream and at least one outlet configured to provide a mixed stream comprising the liquid process stream and a vapor portion of the liquid process stream. The apparatus further includes a heat exchanger disposed within the shell and configured to allow the liquid process stream to absorb heat from steam within the heat exchanger. Additionally, there is a condensate recovery line in communication with an outlet of the heat exchanger and a steam supply line in communication with an inlet of the heat exchanger. The apparatus includes at least one turbine comprising a turbine wheel configured to transmit rotational movement to an electrical generator, the least one turbine being disposed in the condensate recovery line, in the steam supply line, or both.

Additional aspects, embodiments, and details of the invention, all of which may be combinable in any manner, are set forth in the following detailed description of the invention.

DETAILED DESCRIPTION OF THE DRAWINGS

One or more exemplary embodiments of the present invention will be described below in conjunction with the attached FIGURE which is a schematic view of a reboiler that is utilized in one or more aspects of the present invention.

DETAILED DESCRIPTION OF THE INVENTION

As mentioned above, a reboiler with one or more turbines to recover energy from a pressure reduction is used in the various embodiments of the present invention. The energy, in the form of electrical energy is used elsewhere in the processing unit. Additionally, information associated with the amount of electrical energy produced by the turbine is used to adjust processing conditions, other than the throughput of the processing unit, to provide a more efficient operation of the processing unit.

With these general principles in mind, one or more embodiments of the present invention will be described with the understanding that the following description is not intended to be limiting.

The FIGURE depicts an external reboiler system 10 that comprises a vessel 12 with at least one inlet 14 and at least one outlet 18 for a processing unit (not shown). A liquid process stream 16 is passed into the vessel 12, via the inlet 14, and a mixed process stream 20, typically a two phase mixture with a liquid portion and a vapor portion, is recovered from the vessel 12 via the outlet 18.

Inside of the vessel 12, there is a heat exchanger 22 configured to allow for the liquid in the vessel 12 to absorb heat. The heat exchanger 22 includes an inlet 24 and an outlet 26. In various aspects of the present invention the inlet 24 of the heat exchanger receives steam from a steam supply line 28. The steam provides the heat energy that is transferred to the process liquid. A condensate is recovered from the heat exchanger 22, via a condensate recovery line 30 in communication with the outlet 26 of the heat exchanger 22. Any particular configuration for the heat exchanger 22 may be used to practice the present invention, so long as the heat exchanger 22 allows the liquid to absorb heat from the steam. For example, the heat exchanger may include one or more tubes extending within the shell 12. The heat exchanger 22 may be internal to the vessel 12 (as shown) or externally connected to the vessel 12.

As discussed at the outset, in conventional reboilers, before the steam is supplied to the heat exchanger 22, and after the condensate is recovered from the heat exchanger 22, control valves are utilized to adjust a pressure of various streams. According to the present invention, instead of using control valves, turbines 32, 34, 36 are provided in the reboiler to allow for the required pressure reductions and flow control to occur, and to recover some energy associated with the pressure reductions.

For example, in the embodiment depicted in the FIGURE, a turbine 32 is located in the steam supply line 28. This turbine 32 lowers the pressure of the steam to avoid excess heat from being introduced in the heat exchanger 22. Additionally, a boiler feedwater supply line 38 includes a turbine 34 to recover energy as the pressure of the boiler feedwater is reduced. Once the pressure of the boiler feedwater is reduced, the boiler feedwater is mixed with the steam in the steam supply line 28 to remove any super heat from the steam and further control the temperature of the steam supplied to the heat exchanger 22. Notably, as a result of using the turbine 32, as opposed to a control valve, the use of the boiler feedwater supply line 38 can be greatly reduced or eliminated altogether. Finally, a turbine 36 is also located in the condensate recovery line 30 in order to recover energy associated with the pressure reduction of the condensate to regulate the duty of the exchanger and pass to a lower pressure condensate recovery system. It should be appreciated that the depicted configuration of the reboiler 10, with three turbines 32, 34, 36, is intended to be exemplary in nature. Other configurations may be utilized.

The specific configuration for the turbines 32, 34, 36 is also not particularly important for the practicing of the present invention. Exemplary turbines and details of same are described in U.S. Pat. Nos. 4,625,125, 4,694,189, 4,754,156, and 9,203,969 all of which are incorporated herein by reference. For clarity purposes, the turbine 36 in the condensate recovery line 30 will be described with the understanding that the other turbines 32, 34 include similar elements.

The turbines 32, 34, 36 each comprise a turbine wheel 40 with blades 42 configured to transfer, or transmit, rotational movement, created by the flow of a fluid stream passing the turbine wheel 40, to an electrical generator 44. The electrical generator 44 generally includes a first winding 46, in communication with the turbine wheel 40 and a second winding 48 surrounding the first winding 46 and stationary with respect to the first winding 46. As will be appreciated, the rotation of the first winding 46 creates an electrical current in the second winding 46. Additionally, the turbines 32, 34, 36 may include a processor 50 configured to measure an amount of electricity generated by the turbine 32, 34, 36 and a transmitter 52 configured to transmit information associated with the amount of electricity generated by the turbine 32, 34, 36 to a computer 54 at a control center 56 for the processing unit.

Accordingly, in some embodiments, the process according to the present invention comprises directing a portion of a gaseous process stream through one or more variable-resistance turbines to control the flowrate of the gas process stream and, optionally, generate electric power therefrom; controlling a pressure and temperature of the gaseous process stream so that the gas exiting the power-recovery turbine remains in the gas phase; and measuring the flowrate or controlling the flowrate or both using a variable nozzle turbine, inlet variable guide vanes, or direct coupled variable electric load, to name a few, to vary the resistance to flow through the turbine. Again, the resistance to rotation of the variable-resistance turbine can be varied by an external variable load electric circuit which is in a magnetic field from a magnet(s) that is rotating on the turbine. As more load is put on the circuit, there is more resistance to rotation on the turbine. This in turn imparts more pressure drop across the turbine and slows the process stream flow. An algorithm in the device can also calculate the actual flow through the device by measuring the turbine RPMs and the load on the circuit. The resistance to rotation flow can also be varied by variable position inlet guide vanes. In some embodiments, the power will be generated via power-recovery turbines with variable resistance to flow made possible by either guide vanes or variable load on the electrical power generation circuit. An algorithm to calculate actual flow using the guide vanes position, power output and RPMs can be used.

If slow control response of the turbine is an issue then the use of the turbine is limited to slow responding or "loose" control point applications. A slow responding application is contemplated to have a response time to reach half way (i.e., 50% of a difference) between a new (or target) steady state condition (e.g., temperature, pressure, flow rate) from an original (or starting) steady state condition when the new (or target) condition differs from the original (or stating) condition of at least 10%, is of at least one second, or even greater, for example, ten seconds, at least one minute, at least ten minutes, or an hour or more, for half of the change to completed.

In the processes according to various aspects of the present invention, the process fluid is converted in the reboiler 10 from a liquid phase to a mixed liquid/vapor phase. The heat required for the conversion is provided by the steam in the steam supply line 28 to the heat exchanger 22. In the heat exchanger 22, the heat is absorbed from the steam by the process liquid, causing the steam to condense and the process liquid to vaporize. The condensate is recovered from the outlet 26 of the heat exchanger 22.

Prior to passing the steam to the heat exchanger 22, the pressure of the steam is reduced by passing the steam through the turbine 32. Within the turbine 32, the steam passing therethrough will rotate the turbine wheel 40 and, as is known, generate electricity via the electrical generator 44. Additionally, and alternatively, the pressure of the condensate in the condensate recovery line is reduced with the turbine 36 which also generates electricity in the same or similar manner. Furthermore, any boiler feedwater mixed with the steam is passed through the turbine 34 to reduce the pressure of the boiler feedwater, also generating electricity in a same or similar manner. Unlike processes which utilize control valves for the pressure reduction, the present invention provides for the conversion of some of the energy removed via the pressure reductions to electricity.

The present invention may be implemented with a process control system. The process control system described in connection with the embodiments disclosed herein may be implemented or performed on the computer with a general purpose processor, a digital signal processor (DSP), an application specific integrated circuit (ASIC), a field programmable gate array (FPGA) or other programmable logic device, discrete gate or transistor logic, discrete hardware components, or any combination thereof designed to perform the functions described herein. A general-purpose processor may be a microprocessor, or, the processor may be any conventional processor, controller, microcontroller, or state machine. A processor may also be a combination of computing devices, e.g., a combination of a DSP and a microprocessor, two or more microprocessors, or any other combination of the foregoing.

The steps of the processes associated with the process control system may be embodied in an algorithm contained directly in hardware, in a software module executed by a processor, or in a combination of the two. A software module may reside in RAM memory, flash memory, ROM memory, EPROM memory, EEPROM memory, registers, hard disk, a removable disk, a CD-ROM, or any other form of storage medium known in the art. An exemplary storage medium is in communication with the processor reading information from, and writing information to, the storage medium. This includes the storage medium being integral to or with the processor. The processor and the storage medium may reside in an ASIC. The ASIC may reside in a user terminal. Alternatively, the processor and the storage medium may reside as discrete components in a user terminal. These devices are merely intended to be exemplary, non-limiting examples of a computer readable storage medium. The processor and storage medium or memory are also typically in communication with hardware (e.g., ports, interfaces, antennas, amplifiers, signal processors, etc.) that allow for wired or wireless communication between different components, computers processors, or the like, such as between the input channel, a processor of the control logic, the output channels within the control system and the operator station in the control center.

In communication relative to computers and processors refers to the ability to transmit and receive information or data. The transmission of the data or information can be a wireless transmission (for example by Wi-Fi or Bluetooth) or a wired transmission (for example using an Ethernet RJ45 cable or an USB cable). For a wireless transmission, a wireless transceiver (for example a Wi-Fi transceiver) is in communication with each processor or computer. The transmission can be performed automatically, at the request of the computers, in response to a request from a computer, or in other ways. Data can be pushed, pulled, fetched, etc., in any combination, or transmitted and received in any other manner.

According to the present invention, therefore, it is contemplated that the process control system receives information from the turbine 32, 34, 36 relative to an amount of electricity generated by the turbine 32, 34, 36. It is contemplated that the turbine 32, 34, 36 determines (via the processor 50) the amount of electricity it has generated. Alternatively, the process control system receiving the information determines the amount of electricity that has been generated by the turbine 32, 34, 36. In either configuration, the amount of the electricity generated by the turbine 32, 34, 36 is displayed on at least one display screen 58 associated with the computer 54 in the control center 56. If the processing unit comprises a plurality of turbines 32, 34, 36, it is further contemplated that the process control system receives information associated with the amount of electricity generated by each of the turbines 32, 34, 36. The process control system determines a total electrical power generated based upon the information associated with the each of the turbines 32, 34, 36 and displays that the total electrical power generated on the at least one display screen 58. The total electrical power generated may be displayed instead of, or in conjunction with, the amount of electrical power generated by the individual turbines 32, 34, 36.

As discussed above, the electrical energy recovered by the turbines 32, 34, 36 is often a result of removing energy from the streams that was added to the streams in the processing unit. Thus, it is contemplated that the processes according to the present invention provide for the various processing conditions associated with the processing unit to be adjusted into order to lower the energy added to the steam(s).

For example, a simulation is run to determine the amount of harvested electrical energy available at the optimum performance for a specific unit feed and product rate. This amount of harvested electrical energy will then be the basis for reducing the flow through turbine 36 to the amount of steam used in the reboiler 10 for this same amount of feed and product at the optimum operating point.

It is contemplated that the process control system receives information associated with the throughput of the processing unit, and determines a target electrical power generated value for the turbine(s) since the electricity represents energy that is typically added to the overall processing unit. The determination of the target electrical power generated value may be done when the electricity is at or near a predetermined level. In other words, if the amount of electricity produced meets or exceeds a predetermined level, the process control system can determine one or more processing conditions to adjust and lower the amount of electricity generated until it reaches the target electrical power generated value.

Thus, the process control system will analyze one or more changes to the various processing conditions associated with the processing unit to lower the amount of energy recovered by the turbines of the reboiler 10. Preferably, the processing conditions are adjusted without adjusting the throughput of the processing unit. This allows for the processing unit to have the same throughput, but with a lower operating cost associated with the same throughput. The process control system may calculate and display the difference between the target electrical power generated value and the total electrical power generated on the at least one display screen 58.

For example, the process control system may recognize that the total electrical power generated exceeds a predetermined level. Accordingly, the process control system may determine the target electrical power generated value. Based upon other data and information received from other sensors and data collection devices typically associated with the processing unit, the process simulation software may determine that the amount of fuel consumed in the heater associated with the steam of the reboiler can be lowered. While maintaining the throughput of the processing unit, the amount of fuel consumed in the heater is lowered. While this may lower the electricity generated by the turbine, the lower fuel consumption provides a lower operating cost for the same throughput.

Thus, not only does the present invention convert energy that is typically lost into a form that is used elsewhere in the processing unit, the processing units are provided with opportunities to lower the energy input associated with the overall processing unit and increase profits by utilizing more energy efficient processes.

It should be appreciated and understood by those of ordinary skill in the art that various other components such as valves, pumps, filters, coolers, etc. were not shown in the drawings as it is believed that the specifics of same are well within the knowledge of those of ordinary skill in the art and a description of same is not necessary for practicing or understanding the embodiments of the present invention.

SPECIFIC EMBODIMENTS

While the following is described in conjunction with specific embodiments, it will be understood that this description is intended to illustrate and not limit the scope of the preceding description and the appended claims.

A first embodiment of the invention is a process for recovering electrical power from a steam reboiler system with a turbine, the process comprising converting an inlet liquid process stream into a vapor phase and a liquid phase in a reboiler; heating the inlet liquid process stream within the reboiler with a stream of steam with a heat exchanger having an inlet and an outlet; reducing a pressure of the stream of steam with a turbine prior to heating the inlet liquid process stream; recovering condensate from the outlet after heating the inlet liquid process stream; rotating a turbine wheel within the turbine, the turbine wheel configured to transmit rotational movement to an electrical generator; and, generating electricity with the turbine. An embodiment of the invention is one, any or all of prior embodiments in this paragraph up through the first embodiment in this paragraph, further comprising passing the condensate through a turbine. An embodiment of the invention is one, any or all of prior embodiments in this paragraph up through the first embodiment in this paragraph, further comprising mixing the stream of steam with a water stream before heating the inlet liquid process stream. An embodiment of the invention is one, any or all of prior embodiments in this paragraph up through the first embodiment in this paragraph wherein the degrees of superheat in the steam after passing through the turbine is less than 20 degrees C. An embodiment of the invention is one, any or all of prior embodiments in this paragraph up through the first embodiment in this paragraph wherein the degrees of superheat in the steam after passing through the turbine is less than 5 degrees C. An embodiment of the invention is one, any or all of prior embodiments in this paragraph up through the first embodiment in this paragraph further comprising receiving information from the turbine relative to an amount of electricity generated by the turbine; and, displaying the amount of electricity generated by the turbine on at least one display screen. An embodiment of the invention is one, any or all of prior embodiments in this paragraph up through the first embodiment in this paragraph, wherein the process stream is from a processing unit, and the process further comprising receiving information associated with a throughput of the processing unit, determining an electrical power generated target based in part upon the information associated with the throughput of the processing unit. An embodiment of the invention is one, any or all of prior embodiments in this paragraph up through the first embodiment in this paragraph further comprising maintaining the throughput of the processing unit while adjusting at least one process parameter of the processing unit based upon the electrical power generated target. An embodiment of the invention is one, any or all of prior embodiments in this paragraph up through the first embodiment in this paragraph, wherein the processing unit comprises a plurality of turbines each configured to generate electricity, and wherein the process comprises determining a total electrical power generated value based upon the amount of electricity generated by each of the turbines; and, displaying the total electrical power generated value on the at least one display screen. An embodiment of the invention is one, any or all of prior embodiments in this paragraph up through the first embodiment in this paragraph further comprising determining a difference between the electrical power generated target value and the amount of electricity generated by the turbine; and, displaying the difference on the at least one display screen.

A second embodiment of the invention is a process for recovering electrical power from a steam reboiler with a turbine, the process comprising passing a liquid process stream to a reboiler; passing a stream of steam into a heat exchanger disposed within the reboiler; heating the liquid process stream in the reboiler with the stream of steam; recovering a stream of condensate from the heat exchanger; recovering a mixed stream from the reboiler, the mixed stream comprising the liquid process stream and a vapor portion of the liquid process stream; controlling the flow or pressure of the stream of steam with at least one turbine, the at least one turbine being disposed in a condensate recovery line, in a steam supply line, or both; and, generating electricity with the at least one turbine. An embodiment of the invention is one, any or all of prior embodiments in this paragraph up through the second embodiment in this paragraph, wherein the at least one turbine is disposed in the condensate recovery line, and wherein a second turbine is disposed in a steam supply line. An embodiment of the invention is one, any or all of prior embodiments in this paragraph up through the second embodiment in this paragraph, wherein the steam supply line is in communication, downstream of the second turbine, with a water supply line. An embodiment of the invention is one, any or all of prior embodiments in this paragraph up through the second embodiment in this paragraph, wherein the water supply line includes a third turbine.

A third embodiment of the invention is an apparatus for boiling a liquid stream in a reboiler, the apparatus comprising a shell with at least one inlet configured to receive a liquid process stream and at least one outlet configured to provide a mixed stream comprising the liquid process stream and a vapor portion of the liquid process stream; a heat exchanger disposed within the shell and configured to allow the liquid process stream to absorb heat from steam within the heat exchanger; a condensate recovery line in communication with an outlet of the heat exchanger; a steam supply line in communication with an inlet of the heat exchanger; and, at least one turbine comprising a turbine wheel configured to transmit rotational movement to an electrical generator, the least one turbine being disposed in the condensate recovery line, in the steam supply line, or both. An embodiment of the invention is one, any or all of prior embodiments in this paragraph up through the third embodiment in this paragraph wherein the at least one turbine is disposed in the condensate recover line and a second turbine is disposed in the steam supply line. An embodiment of the invention is one, any or all of prior embodiments in this paragraph up through the third embodiment in this paragraph wherein the at least one turbine is disposed in the steam supply line. An embodiment of the invention is one, any or all of prior embodiments in this paragraph up through the third embodiment in this paragraph, wherein the at least one turbine is disposed in the steam supply line, and the apparatus further comprising a water supply line in communication with the steam supply line downstream of turbine. An embodiment of the invention is one, any or all of prior embodiments in this paragraph up through the third embodiment in this paragraph, further comprising a second turbine disposed in the water supply line. An embodiment of the invention is one, any or all of prior embodiments in this paragraph up through the third embodiment in this paragraph, further comprising a transmitter associated with the at least one turbine, the transmitter configured to transmit information associated with an amount of electricity generated by the turbine.

Without further elaboration, it is believed that using the preceding description that one skilled in the art can utilize the present invention to its fullest extent and easily ascertain the essential characteristics of this invention, without departing from the spirit and scope thereof, to make various changes and modifications of the invention and to adapt it to various usages and conditions. The preceding preferred specific embodiments are, therefore, to be construed as merely illustrative, and not limiting the remainder of the disclosure in any way whatsoever, and that it is intended to cover various modifications and equivalent arrangements included within the scope of the appended claims.

In the foregoing, all temperatures are set forth in degrees Celsius and, all parts and percentages are by weight, unless otherwise indicated.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention, it being understood that various changes may be made in the function and arrangement of elements described in an exemplary embodiment without departing from the scope of the invention as set forth in the appended claims and their legal equivalents.

What is claimed is:

1. A process for recovering electrical power from a steam reboiler system, the process comprising:

converting an inlet liquid process stream from a processing unit into a vapor phase and a liquid phase in a reboiler;

heating the inlet liquid process stream within the reboiler with a stream of steam using a heat exchanger having an inlet and an outlet;

reducing a pressure of the stream of steam with a turbine prior to heating the inlet liquid process stream, wherein the steam after the pressure reduction comprises a superheat steam, and the degrees of superheat in the steam after passing through the turbine is less than 20 degrees C.;

recovering condensate from the outlet after heating the inlet liquid process stream;

rotating a turbine wheel within the turbine, the turbine wheel configured to transmit rotational movement to an electrical generator;

generating electricity with the turbine;

receiving information from the turbine relative to an amount of electricity generated by the turbine;

receiving information associated with a throughput of the processing unit; and, determining an electrical power generated target based in part upon the information associated with the throughput of the processing unit, wherein the amount of electricity generated by the turbine meets or exceeds the electrical power generated target, and wherein the process further comprises maintaining the throughput of the processing unit while reducing a flow of fuel to a heater producing the stream of steam.

2. The process of claim 1, further comprising:

passing the condensate through a second turbine.

3. The process of claim 1, further comprising:

mixing the stream of steam with a water stream before heating the inlet liquid process stream.

4. The process of claim 1 wherein the degrees of superheat in the steam after passing through the turbine is less than 5 degrees C.

5. The process of claim 1 further comprising:

displaying the amount of electricity generated by the turbine on at least one display screen.

6. The process of claim 1, wherein the processing unit comprises a plurality of turbines each configured to generate electricity, and wherein the process comprises:

determining a total electrical power generated value based upon the amount of electricity generated by each of the turbines; and, displaying the total electrical power generated value on at least one display screen.

7. The process of claim 1 further comprising:

determining a difference between the electrical power generated target and the amount of electricity generated by the turbine; and, displaying the difference on at least one display screen.

8. A process for recovering electrical power from a steam reboiler system, the process comprising:

passing a liquid process stream of a processing unit to a reboiler;

passing a stream of steam into a heat exchanger disposed within the reboiler, wherein the steam comprises superheat steam and the degrees of superheat in the steam is less than 20 degrees C.;

heating the liquid process stream in the reboiler with the stream of steam;

recovering a stream of condensate from the heat exchanger;

recovering a mixed stream from the reboiler, the mixed stream comprising the liquid process stream and a vapor portion of the liquid process stream;

controlling the flow or pressure of the stream of steam with at least one turbine, the at least one turbine being disposed in a condensate recovery line, in a steam supply line, or both;

generating electricity with the at least one turbine;

receiving information from the at least one turbine relative to an amount of electricity generated by the at least one turbine;

receiving information associated with a throughput of the processing unit; and, determining an electrical power generated target based in part upon the information associated with the throughput of the processing unit, wherein the amount of electricity generated by the at least one turbine meets or exceeds the electrical power generated target, and wherein the process further comprises maintaining the throughput of the processing unit while reducing a flow of fuel to a heater producing the stream of steam.

9. The process of claim 8, wherein a first turbine of the at least one turbine is disposed in the condensate recovery line, and wherein a second turbine of the at least one turbine is disposed in the steam supply line.

10. The process of claim 9, wherein the steam supply line is in communication, downstream of the second turbine, with a water supply line.

11. The process of claim 10, wherein the water supply line includes a third turbine.

* * * * *